US008331598B2

(12) United States Patent
Li

(10) Patent No.: US 8,331,598 B2
(45) **Date of Patent: *Dec. 11, 2012**

(54) AUDIO SYSTEM FOR OUTDOOR UMBRELLA

(75) Inventor: Wanda Ying Li, Baldwin Park, CA (US)

(73) Assignee: Oliver Joen-An Ma, Arcadia, CA (US)

( * ) Notice: Subject to any disclaimer, the term of this patent is extended or adjusted under 35 U.S.C. 154(b) by 1509 days.

This patent is subject to a terminal disclaimer.

(21) Appl. No.: 11/796,264

(22) Filed: Apr. 27, 2007

(65) Prior Publication Data

US 2008/0118089 A1 May 22, 2008

(51) Int. Cl.
*H04R 1/02* (2006.01)

(52) U.S. Cl. ..... 381/332; 381/87; 381/334; 381/386; 135/16; 135/15.1; 135/17

(58) Field of Classification Search ..... 381/124, 381/87, 334, 332, 386; 135/16, 15.1, 17
See application file for complete search history.

(56) References Cited

U.S. PATENT DOCUMENTS

| | | | | |
|---|---|---|---|---|
| 5,273,062 | A * | 12/1993 | Mozdzanowski | 135/16 |
| 5,584,564 | A * | 12/1996 | Phyle | 362/102 |
| 2003/0102021 | A1* | 6/2003 | Cohen et al. | 135/16 |
| 2003/0168091 | A1* | 9/2003 | Cohen et al. | 135/16 |
| 2004/0256852 | A1* | 12/2004 | Benedict | 280/806 |

* cited by examiner

*Primary Examiner* — Disler Paul
(74) *Attorney, Agent, or Firm* — Raymond Y. Chan; David and Raymond Patent Firm

(57) ABSTRACT

An audio system for an outdoor umbrella includes an audio housing, a detachable locker, and an audio device. The audio housing includes a first housing body and a second housing body defining a mounting slot for a shaft of the outdoor umbrella fitting therewithin. The detachable locker includes a first locker provided at the first housing body and a second locker which is provided at the second housing body and is releasably locked with the first locker so as to detachably lock up the second housing body with the first housing body. The audio device includes a speaker supported in the first housing body and an audio input operatively coupling with the speaker such that when the audio input sends an audio signal to the speaker, the speaker is adapted for producing audio sound as an additional function for the outdoor umbrella.

16 Claims, 15 Drawing Sheets

AUDIO SYSTEM FOR OUTDOOR UMBRELLA

BACKGROUND OF THE PRESENT INVENTION

1. Field of Invention

The present invention relates to an outdoor umbrella, and more particularly to an audio system which is adapted to detachably mount to a conventional outdoor umbrella so as to provide an add-on function for the conventional outdoor umbrella without altering its original structure.

2. Description of Related Arts

Outdoors umbrellas are set up in many places such as in beach areas, in patio areas, in campsites or in domestic gardens etc. They are usually used for shading sunlight in the daytime. A conventional outdoors umbrella usually comprises an umbrella base, a supporting stem upwardly extended therefrom, a foldable awning frame which comprises a plurality of awning supporting arms radically and outwardly extended from an upper end portion of the supporting stem, and n fabric-made awning securely and foldably mounted on the awning supporting arms.

Users would always like to listen to the music at their leisure such that the users usually carry a portable music player. However, such portable music player cannot be mounted to the outdoor umbrella. In other words, most of the users prefer the outdoor umbrella with built-in audio system. Actually, mounting an audio system on the outdoors umbrella is a challenging task. Not to mention the problems arise when one tries to design the mechanical connection between the audio system and the outdoors umbrella without interfering its smooth folding action, it is the problem as how to provide the audio system with enough and convenient power source which simply possesses the main difficulty in designing a practical audio system.

Since the outdoors umbrellas, as the name implies, are designed for use in outdoors, existence of an electrical power source cannot be guaranteed. Even through there are electrical sources exist, a tedious connection between the audio system and the electrical source is unavoidable in that long wires have to be used. For some cases, the audio systems may be compatible with portable dynamos, however, bring a bulky dynamo with the outdoor umbrella is not really a wise decision. Once the electrical connection the audio system is broken, the user is unable to replace the audio system. In other words, once the audio system is malfunction, the mood of all the participants may be ruined.

As a matter of fact, the very purpose of using outdoors umbrella is to shade vigorous sunlight. Therefore, it would be more economical, more convenient and more environmentally friendly if one were able to detachably add an additional audio system to any conventional outdoor umbrella for providing an add on function thereto without alternating the original structure of the outdoor umbrella.

SUMMARY OF THE PRESENT INVENTION

A main object of the present invention is to provide an audio system for an outdoor umbrella, wherein the audio system is adapted to detachably mount to a conventional outdoor umbrella so as to provide an add-on function for the conventional outdoor umbrella without altering its original structure.

Another object of the present invention is to provide an audio system for an outdoor umbrella, wherein no electric wire is required to electrically connect the audio system with the outdoor umbrella. In other words, the audio system provides an independent power supply such that the audio system does not require any power supply from the outdoor umbrella.

Another object of the present invention is to provide an audio system for an outdoor umbrella, wherein the audio system is adapted to detachably mount to any type of outdoor umbrella having an elongated shaft. Therefore, the user is able to mount the audio system from one outdoor umbrella to another outdoor umbrella easily.

Another object of the present invention is to provide an audio system for an outdoor umbrella, wherein the audio system does not significantly alter the original structure of the outdoors umbrella, so as to minimize the manufacturing and marketing costs of the audio system incorporating with the outdoor umbrella.

Another object of the present invention is to provide an audio system for an outdoor umbrella, wherein no complicated mechanical and electrical processes are involved in installing and mounting the audio system on the outdoor umbrella.

Another object of the present invention is to provide an audio system for an outdoor umbrella, wherein the audio system further provides an added lighting function for providing illumination.

Accordingly, in order to accomplish the above objects, the present invention provides an audio system for an outdoor umbrella having a shaft, comprising:

an audio housing which comprises a first housing body and a second housing body defining a mounting slot when the first and second housing bodies are coupled with each other, wherein the mounting slot has a size for the shaft of the outdoor umbrella fitting therewithin;

a detachable locker comprising a first locker provided at the first housing body and a second locker which is provided at the second housing body and is releasably locked with the first locker so as to detachably lock up the second housing body with the first housing body; and an audio device which comprises a speaker supported in the first housing body and an audio input operatively coupling with the speaker such that when the audio input sends an audio signal to the speaker, the speaker is adapted for producing audio sound as an additional function for the outdoor umbrella.

These and other objectives, features, and advantages of the present invention will become apparent from the following detailed description, the accompanying drawings, and the appended claims.

DETAILED DESCRIPTION OF THE PREFERRED EMBODIMENT

Figure 1:
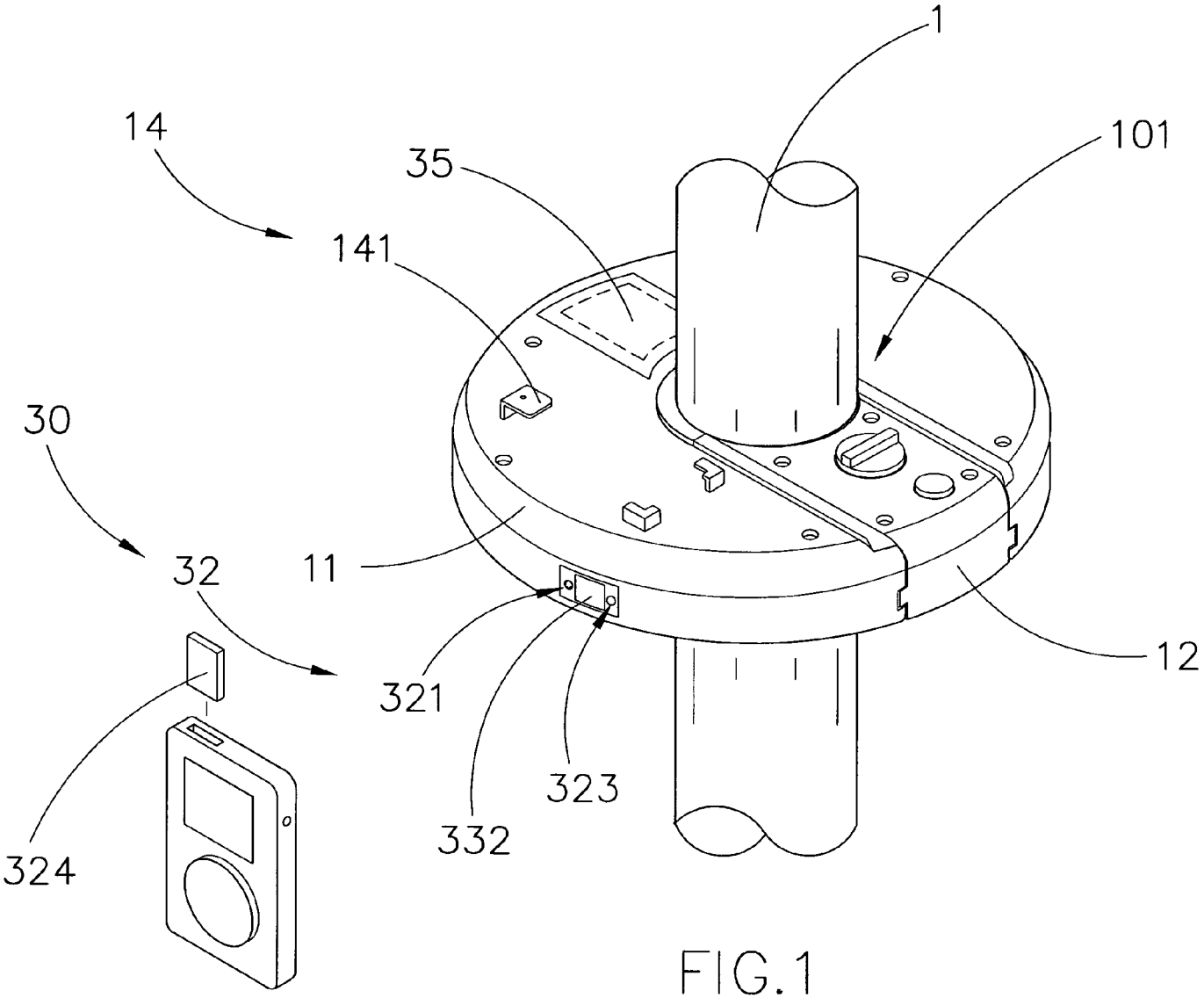
FIG. 1 is a top perspective view of an audio system for an outdoor umbrella according to a first preferred embodiment of the present invention.
Figure 2:
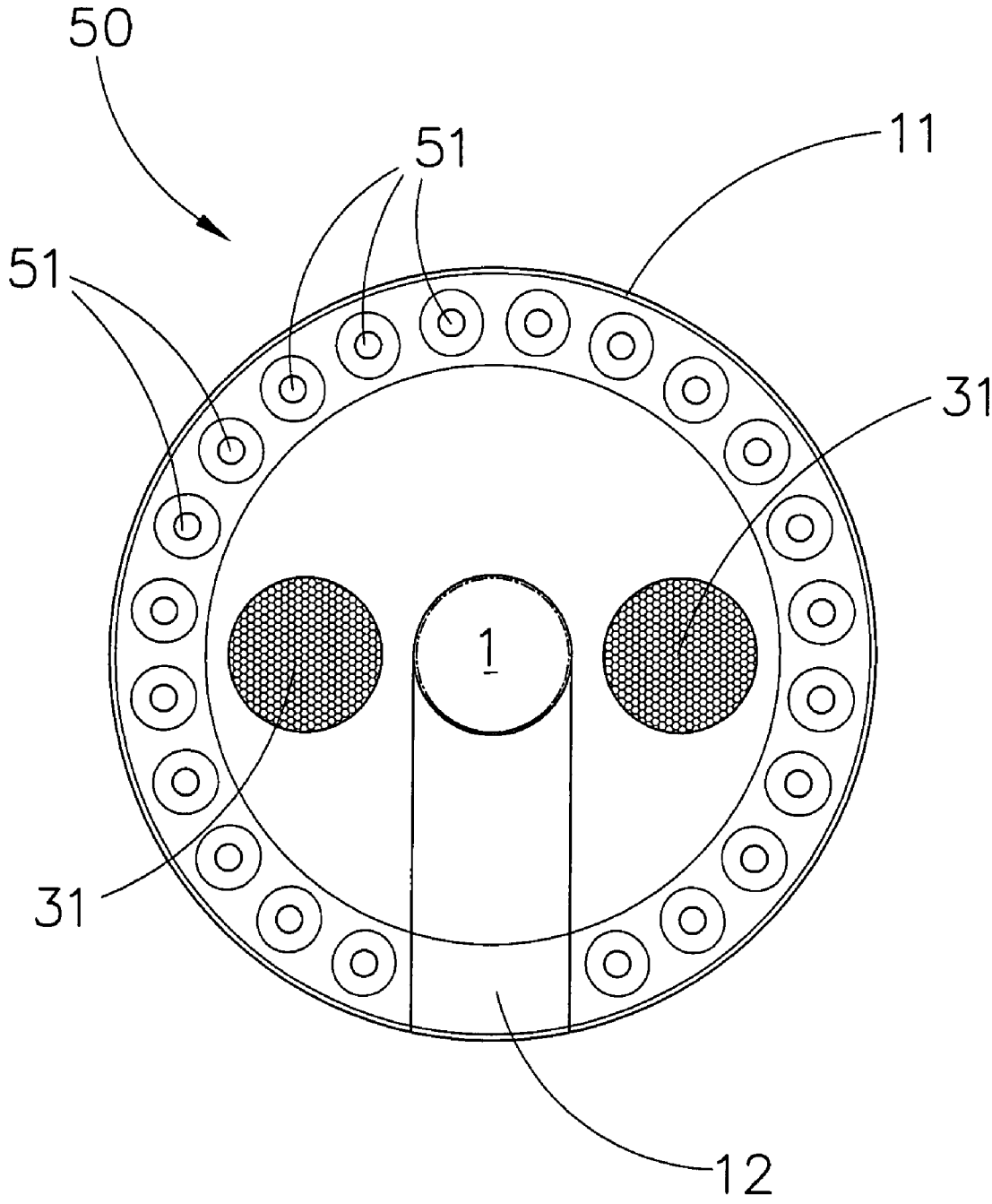
FIG. 2 is a bottom view of the audio system according to the above first preferred embodiment of the present invention.
Figure 3:
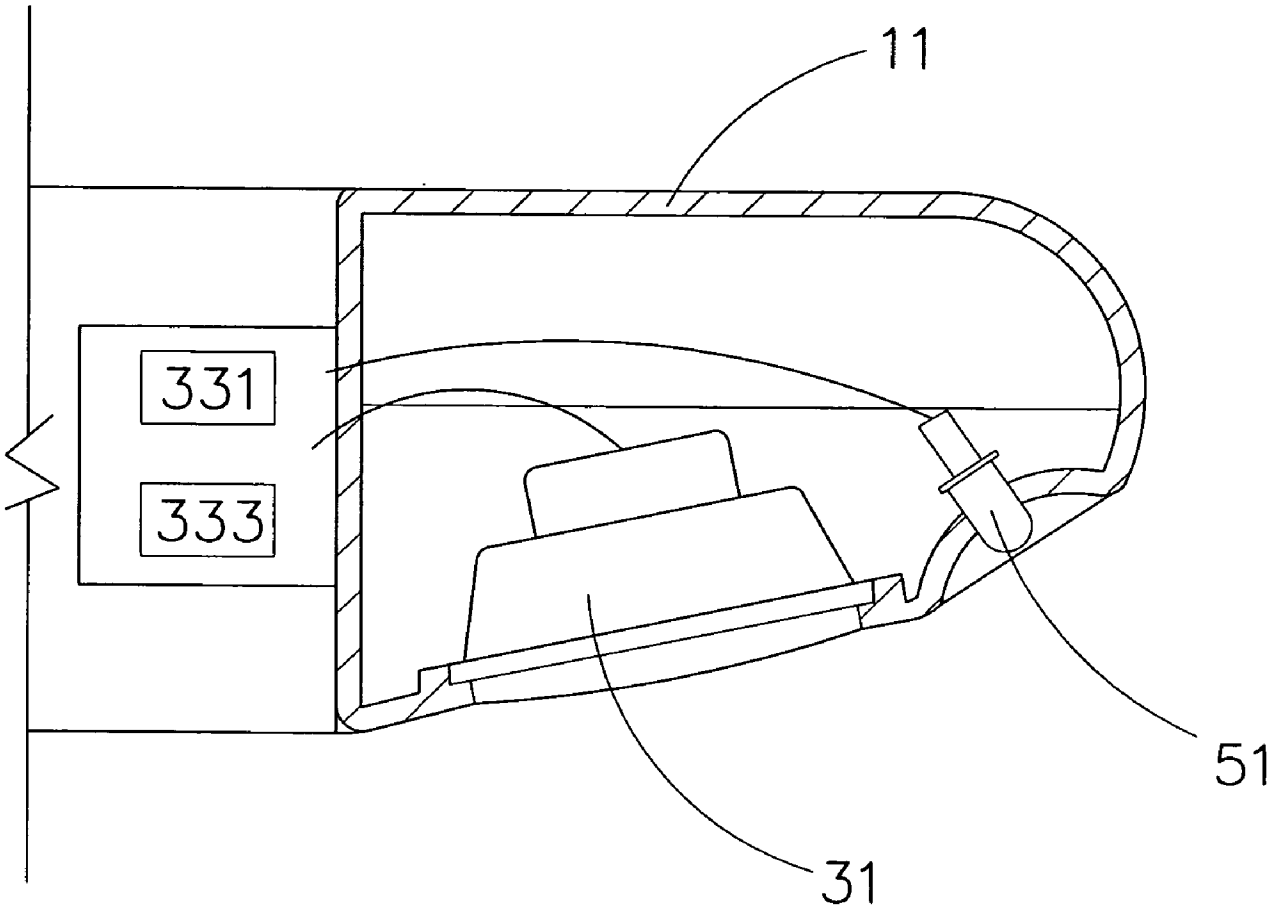
FIG. 3 is a partially sectional view of the audio system according to the above first preferred embodiment of the present invention.
Figure 13:
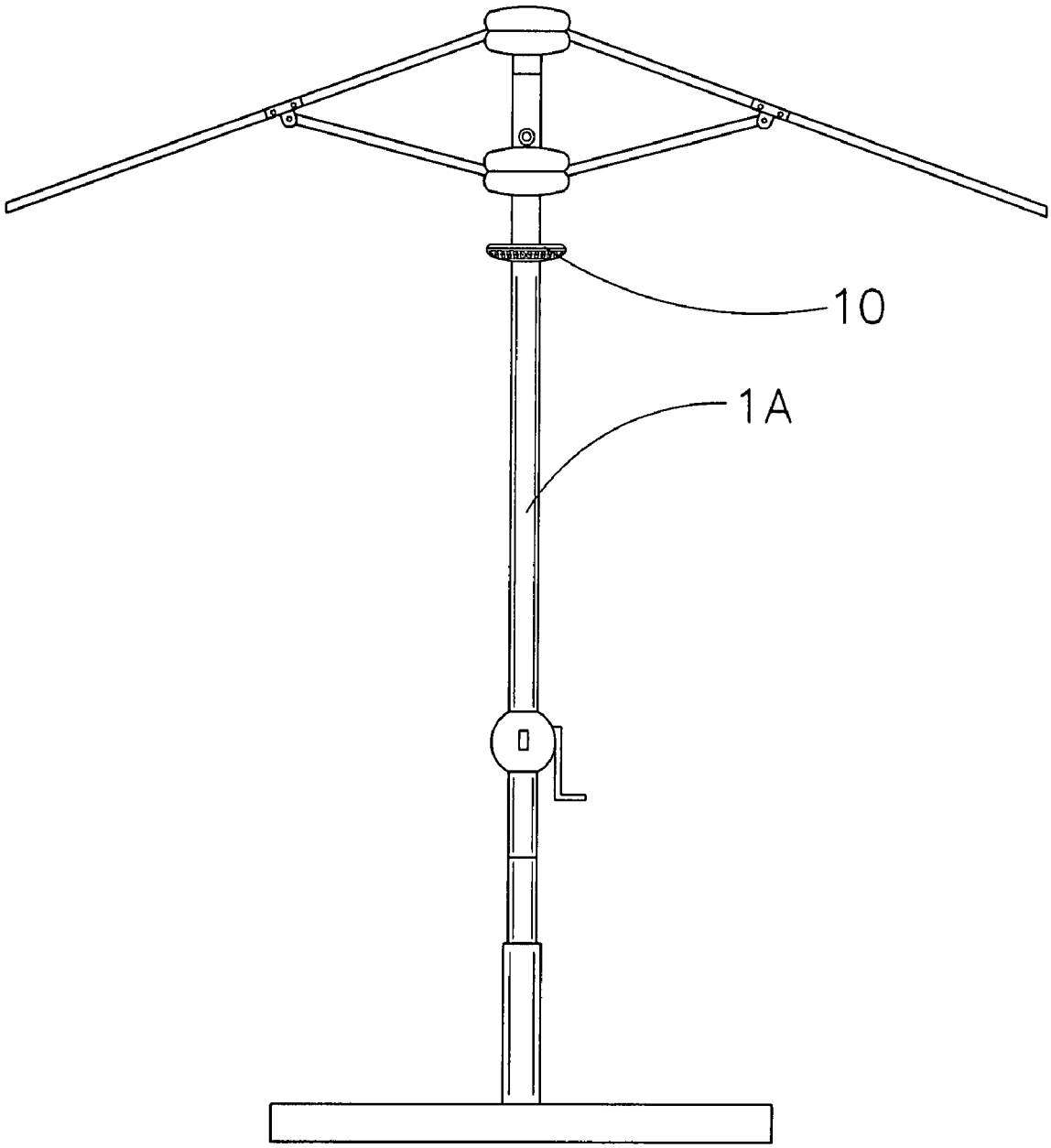
FIG. 13 illustrates the audio system of the present invention being mounted to the supporting shaft of the outdoor umbrella.
Figure 14:
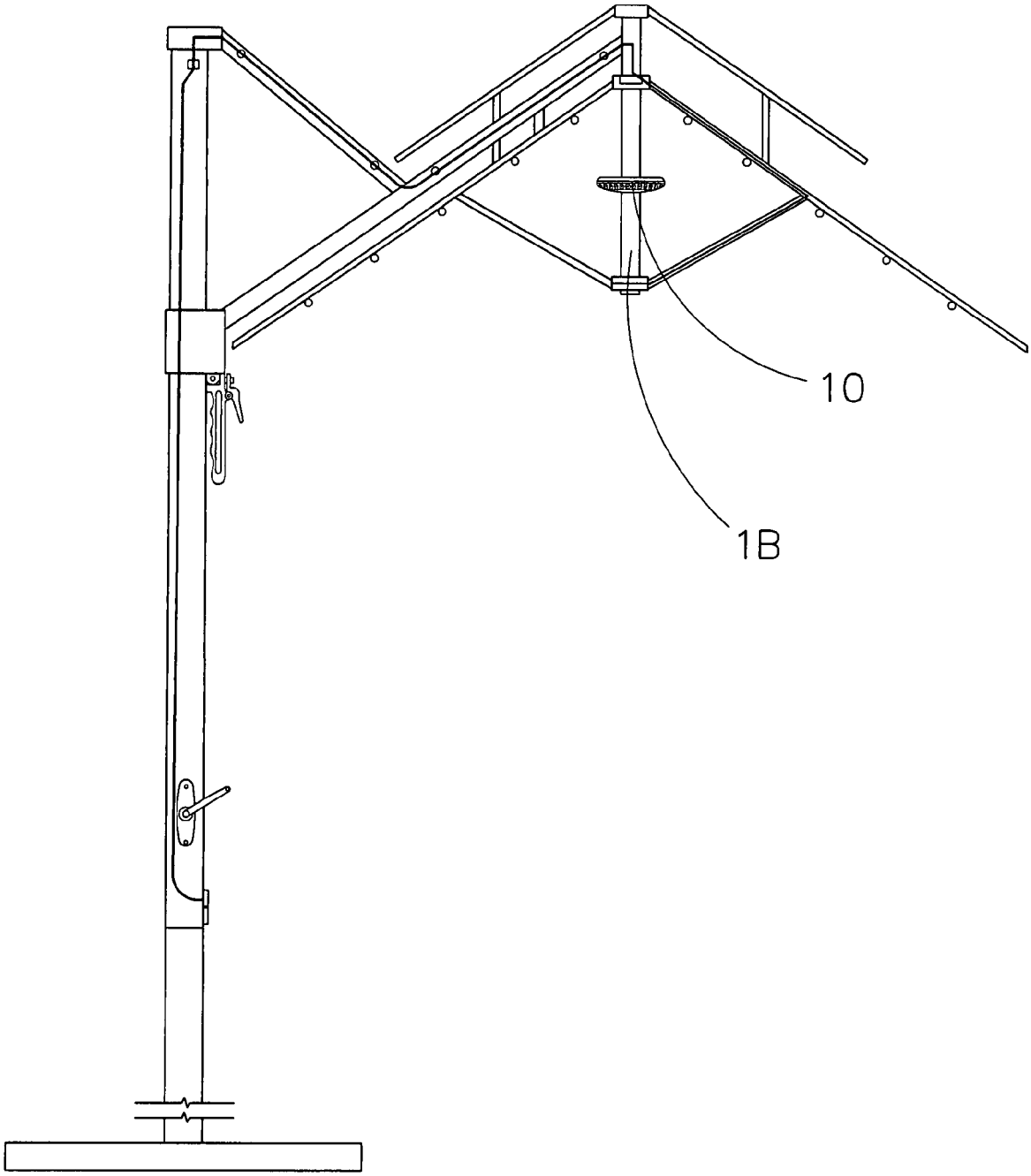
FIG. 14 illustrates the audio system of the present invention being mounted to the upper portion of the awning shaft of the outdoor umbrella.
Figure 15:
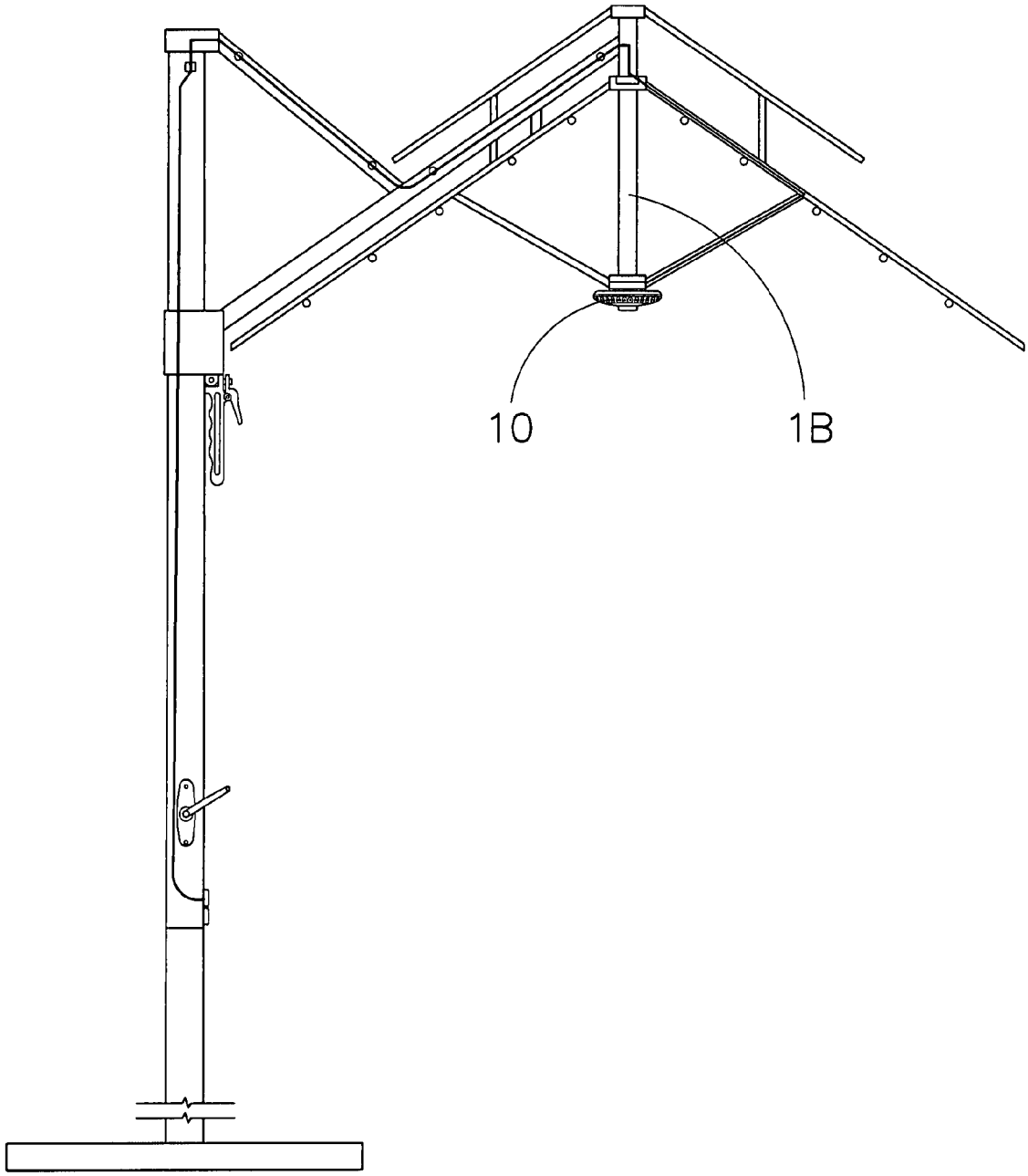
FIG. 15 illustrates the audio system of the present invention being mounted to the lower portion of the supporting shaft of the outdoor umbrella.

Referring to FIGS. 1 and 2 of the drawings, an audio system for an outdoor umbrella is illustrated, wherein the audio system is adapted to detachably mount to the shaft 1 of the outdoor umbrella. As shown in FIG. 13 the audio system of the present invention is detachably mounted to the supporting shaft 1A of the outdoor umbrella. As shown in FIGS. 14 and 15, the audio system of the present invention is detachably mounted to the upper and lower portions of the awning shaft 1B of the outdoor umbrella.

According to the preferred embodiment, the audio system comprises an audio housing 10, a detachable locker 20 and an audio device 30.

The audio housing 10 comprises a first housing body 11 and a second housing body 12 defining a mounting slot 101 when the first and second housing bodies 11, 12 are coupled with each other, wherein the mounting slot 101 has a size for the shaft 1 of the outdoor umbrella fitting therewithin.

The detachable locker 20 comprises a first locker 21 provided at the first housing body 11 and a second locker 22 which is provided at the second housing body 12 and is releasably locked with the first locker 21 so as to detachably lock up the second housing body 11 with the first housing body 12.

The audio device 30 comprises one of more speakers 31 supported in the audio housing 10 and an audio input 32 operatively coupling with the speaker 31 such that when the audio input 32 sends an audio signal to the speaker 31, the speaker 31 is adapted for producing audio sound as an additional function for the outdoor umbrella.

According to the first embodiment, the first housing body 11, having a U-shaped structure, has two inner guiding walls 111 defining a guiding channel 112 therebetween. The second housing body 12, having a corresponding elongated shape, has two outer guiding walls 121 engaging with the inner guiding walls 111 of the first housing body 11. When the first and second housing bodies 11, 12 are mounted with each other, the audio housing 11 is formed to have a donut shape and to define the mounting slot at a center of the audio housing 10.

The guiding channel 112 has a closed end defining the mounting slot 101 thereat and an opened end arranged when the second housing body 12 is slidably mounted to the first housing body 11 along the guiding channel 101 through the opened end thereof, the mounting slot 101 is formed at the closed end of the guiding channel 112. In other words, the mounting slot 101 is formed by the closed end of the guiding channel 112 and the inner side of the second housing body 12.

The audio housing 10 further comprises two first sliders 131 indent along the inner guiding walls 111 of the first housing body 11 respectively and two corresponding second sliders 132 protruded along the outer guiding walls 121 of the second housing body 12 respectively such that when the second sliders 132 are slidably engaged with the first sliders 131 respectively, the second housing 12 is slidably mounted to the first housing 11.

According to the first embodiment, there are two speakers 31 spacedly mounted in the first housing body 11 for generating the audio sound in stereo manner. The audio input 32 comprises an auxiliary input 321 provided on the audio housing for communicatively connecting a portable music player to receive the audio signal therefrom, such that the audio signal is transmitted to the speakers 31 for music broadcasting. Preferably, the auxiliary input 321 is provided on the outer surface of the first housing body 11 for the user to connect the portable music player to the speakers 31.

The audio input 32 further a wireless receiver 323 supported in the audio housing 10 to electrically connect with the speakers 31 and a wireless transmitter 324 which is wirelessly linked with the wireless receiver 323 and is adapted for connecting with the portable music player to wirelessly sending the audio signal from the portable music player to the speakers 31 for music broadcasting. Accordingly, the wireless receiver 323 is a FM receiver and the wireless transmitter 324 is a FM transmitter such that the wireless receiver 323 and the wireless transmitter 324 form a wireless link to wirelessly send the audio signal from the portable music player to the speakers 31. Therefore, when the wireless transmitter 324 is tuned automatically or manually to match the radio frequency of the wireless receiver 323, the audio device 30 is wirelessly connected with the portable music player. Accordingly, the audio housing 10 further comprises a device holder 14 provided at the first housing body 11 for detachably holding the portable music player in position, wherein the device holder 14 comprises a plurality of holder arms 141 spacedly extended from a top side of the first housing body 11 to define a holding compartment for securely receiving the portable music player therein.

The audio device 30 further comprises a control panel 33 which is provided at the audio housing 10, comprising a control circuitry 331 operatively connecting to the speakers 31 to selectively operate and control the speaker and a display screen 332 electrically connected to the control circuitry 331 for displaying an operation status thereof. It is worth to mention that the control circuitry 331 is also operatively connected to the wireless receiver 323 to operate and control the wireless receiver 323. Accordingly, a remote controller can be incorporated to remote control the audio device 30.

The control panel 33 further comprises a radio broadcasting circuit 333 for receiving radio wave as the audio signal, such that the control panel 33 transmits the audio signal to the speakers 31 for radio broadcasting. In other words, the user is able to listen to the music from his or her portable music player or to the radio through the audio system of the present invention.

The audio device 30 further comprises a power supply 35 supported in the audio housing 10 to electrically connect with the speakers 31 and the control panel 33. Accordingly, the power supply 35 can be a rechargeable battery or a replaceable battery such that the audio device 30 does not require any electrical power from the outdoor umbrella. Alternatively, the power supply 35 can be electrically connected to the power source of the outdoor umbrella, especially the outdoor umbrella incorporating with a solar energy.

The audio system further comprises a lighting device 50 for providing illumination under the audio housing 10. The lighting device 50 comprises a plurality of illuminators 51 spacedly supported in the outer circumferential portion of the first housing body 11 and electrically coupling with the control panel 33. Accordingly, each of the illuminators 51 is a LED having a head portion protruded from the bottom side of the first housing body 11 and a tail portion electrically connecting to the control panel 33.

Figure 4:
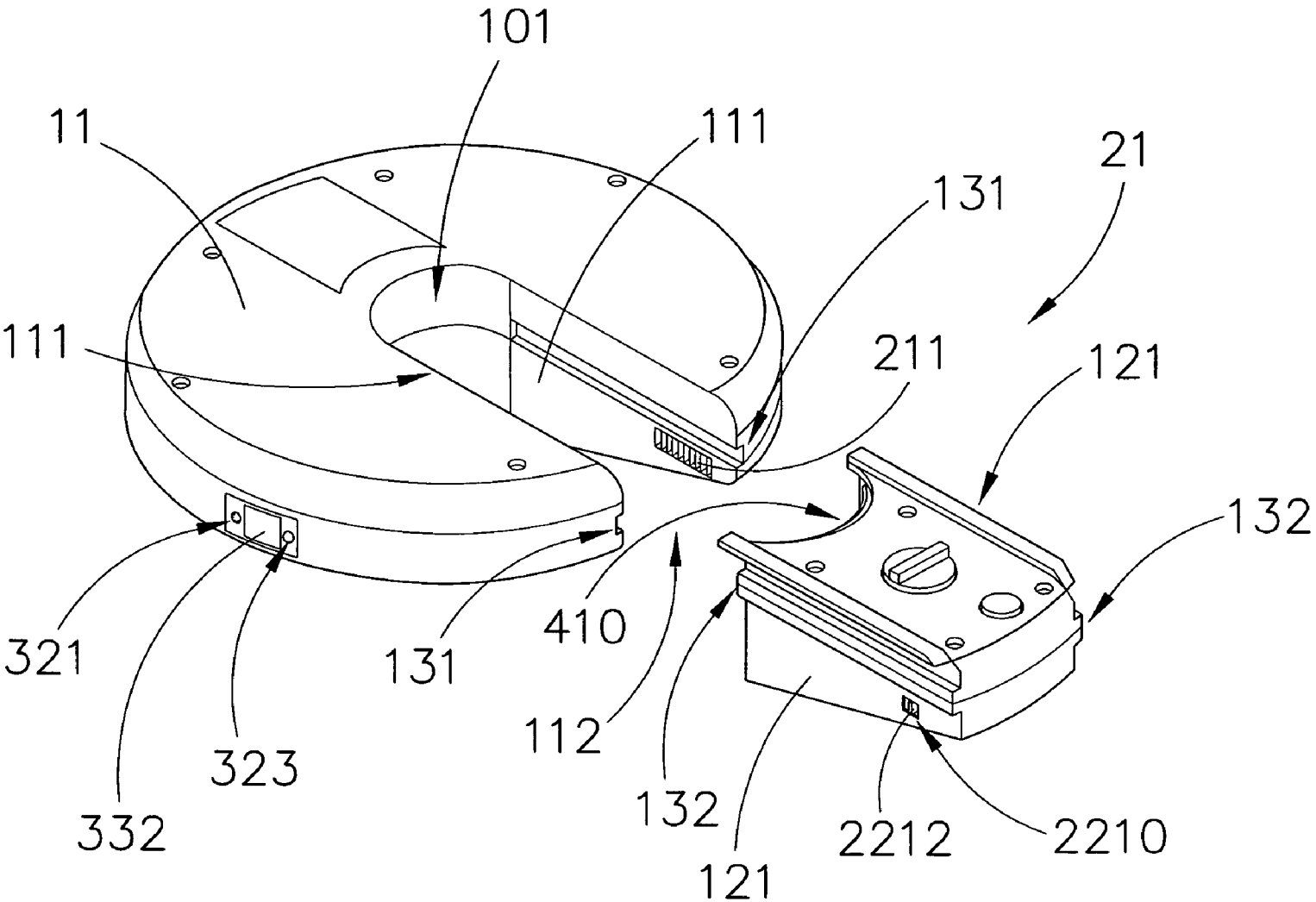
FIG. 4 is an exploded perspective view of the audio housing of the audio system according to the above first preferred embodiment of the present invention.
Figure 5:
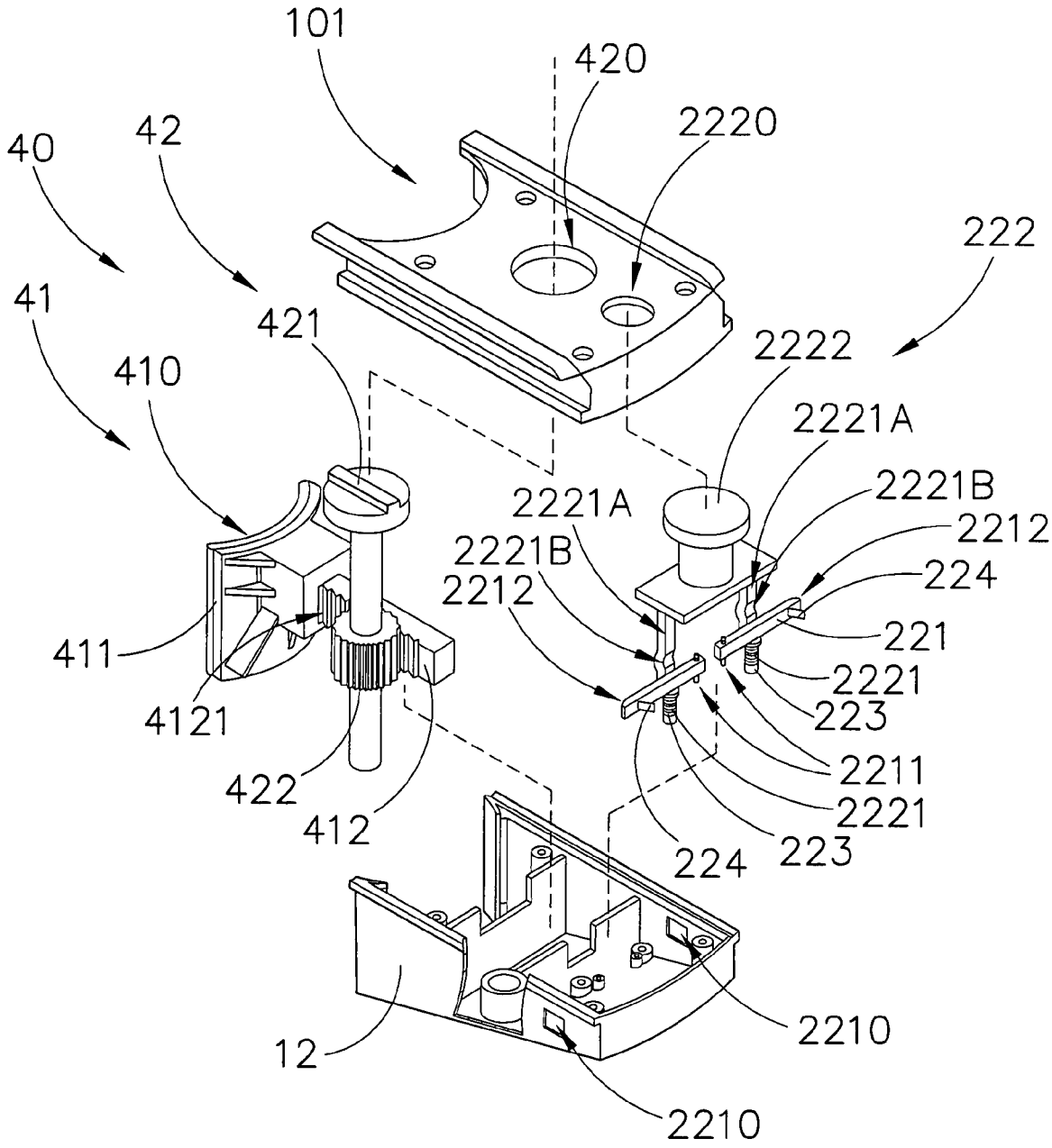
FIG. 5 is an exploded perspective view of the detachable locker and the adjustable retainer of the audio system according to the above first preferred embodiment of the present invention.

As shown in FIGS. 4 to 5, the first locker 21 comprises two toothed-locking tracks 211 provided at the inner guiding walls 111 of the first housing body 11 respectively. Accordingly, each of the toothed-locking tracks 211 is formed at the respective inner guiding wall 111 of the first housing body 11 at a position close to the opened end of the guiding channel 112.

The second locker 22 comprises two locking arms 221 outwardly extended from the outer guiding walls 121 of the second housing 12 and a lock actuator 222 actuating the locking arms 221 not only to engage with the toothed-locking tracks 211 respectively for locking up the second housing body 12 with the first housing body 11 but also to disengage with the toothed-locking tracks 211 respectively for releasing the second housing body 12 with the first housing body 11 so as to allow the second housing body 12 being detached from the first housing body 11.

As shown in FIG. 5, each of the locking arms 221 has an inner pivot end 2211 pivotally mounted in the second housing body 12 and an outer locking end 2212 outwardly protruded from the respective outer guiding wall 121 of the second housing body 12 through a locking hole 2210 to selectively engage with the respective toothed-locking track 211. Therefore, when the inner pivot end 2211 of each of the locking arm 221 is moved pivotally, the outer locking end 2212 of the locking arm 221 is driven to pivotally move to engage or disengage with the tooth-locking track 211.

The lock actuator 222 comprises two actuating legs 2221 movably mounted in the second housing body 12 to engage with the locking arms 221 respectively and a control pusher 2222 which is extended from the actuating legs 2221 to an exterior of the second housing body 12 and is arranged in such a manner that when the control pusher 2222 is depressed, the actuating legs 2221 are pushed to pivotally move the locking arms 221 at a position that the locking ends 2212 of the locking arms 221 are moved into an interior of the second housing body 12 through the locking holes 2210 so as to disengage the locking ends 2212 of the locking arms 221 with the toothed-locking tracks 211 respectively.

Accordingly, a bottom portion of the lock actuator 222 has a U-shaped structure defining the two actuating legs 2221 extending downwardly to couple with the locking arms 221. The upper portion of the locking actuator 222 has an elongated structure defining the control pusher 2222 extending upwardly to protrude out of the second housing body 12 through a through pushing hole 2220, wherein when the control pusher 2222 is depressed, the two actuating legs 2221 are driven downwardly to pivotally move the two locking arms 221 respectively.

In order to pivotally move the locking arms 221 to engage/disengage with the toothed-locking tracks 211 respectively, each of the actuating legs 2221 has a straight biasing portion 2221A and a curved releasing portion 2221B that the locking arms 221 are normally engaged with the curved releasing portions 2221B of the actuating legs 2221 to retain the locking ends 2212 of the locking arms 221 engaging with the toothed-locking tracks 211 respectively. When the control pusher 2222 is depressed to move the actuating legs 2221, the locking arms 221 are engaged with the straight biasing portions 2221A of the actuating legs 2221 to pivotally move the locking ends 2212 of the locking arms 221 into the interior of the second housing body 12 through the locking holes 2210 so as to disengage the locking ends 2212 of the locking arms 221 with the toothed-locking tracks 211 respectively.

Accordingly, the straight biasing portion 2221A of the actuating leg 2221 is integrally extended from the curved releasing portion 2221B thereof such that when the actuating legs 2221 are driven to moved downwardly by the depression of the control pusher 2222, the locking arms 221 are moved from the curved releasing portion 2221B of the actuating legs 2221 to the straight biasing portion 2221A thereof so as to pivotally move the locking ends 2212 of the locking arms 221 to disengage with the toothed-locking tracks 211 respectively.

As shown in FIG. 5, the second locker 22 further comprises two first resilient elements 223 mounted at two free ends of the actuating legs 2221 for applying an urging force against the control pusher 222 to retain the control pusher 222 in a normal position and two second resilient elements 224 provided at the two locking arms 221 for applying a pushing force against the locking arms 221 with respect to sidewalls of the locking holes 2210 so as to retain the locking ends 2212 of the locking arms 221 to engage with the toothed-locking tracks 211 respectively.

The first resilient elements 223 are two compression springs mounted at the free ends of the actuating legs 2221 and held at the bottom wall of the second housing body 12, wherein the first resilient elements 223 normally apply the urging force against the lock actuator 222 to retain the locking arms 221 being normally engaged with the curved releasing portions 2221B of the actuating legs 2221. In other words, after the control pusher 222 is depressed, the first resilient elements 223 apply an upward pushing force to the lock actuator 222 so as to push the locking arms 221 back to engage with the curved releasing portions 2221B of the actuating legs 2221 from the straight biasing portion 2221A thereof.

The second resilient elements 224 are two spring pieces mounted at the two locking arms 221 close to the locking ends 2212 thereof respectively, wherein the second resilient elements 224 normally apply the urging force against the locking arms 221 to push the locking ends thereof to engage with the toothed-locking tracks 211 respectively. Therefore, after the locking arms 221 is returned back to engage with the curved releasing portions 2221B of the actuating legs 2221, the second resilient elements 224 will push the locking arms 221 to pivotally moved back to engage with the toothed-locking tracks 211 respectively.

As shown in FIG. 5, the audio system further comprises an adjustable retainer 40 for adjusting the size of the mounting slot 101 for the shaft 1 of the outdoor umbrella, wherein the adjustable retainer 40 comprises a retention arm 41, having a pusher surface 410 facing towards the mounting slot 101, slidably mounted the second housing body 12 and an adjustable locker 42 controllably driving the retention arm 41 at a position that when the retention arm 41 is driven towards mounting slot 101, the pusher surface 410 is arranged for biasing against an outer surface of the shaft 1 of the outdoor umbrella until the shaft 1 thereof being fitted at the mounting slot 101 so as to substantially mount the audio housing 10 at the outdoor umbrella.

According to the preferred embodiment, the retention arm 41 comprises a pusher head 411 defining the pusher surface 410 thereat and a driving arm 412, having a toothed track 4121, extended from the pusher head 411. The pusher head 411 is extended out of the second housing body 12 at the inner side thereof such that when the pusher head 411 is moved in the second housing body 12, the size of the mounting slot 101 is adjustably enlarged. In other words, when the pusher head 411 is moved out of the second housing body 12, the size of the mounting slot 101 is substantially reduced.

It is worth to mention that when the shaft 1 of the outdoor umbrella has a circular cross section, the pusher surface 410 is formed as a curved surface corresponding to the curvature of the outer surface of the shaft 1 of the outdoor umbrella such that when the pusher surface 410 is engaged with the outer surface of the shaft 1 of the outdoor umbrella, the audio housing 10 can be securely mounted around the shaft 1 of the outdoor umbrella. In other words, when the shaft 1 of the outdoor umbrella has a flat outer surface, the pusher surface 410 is formed to have a flat surface to substantially bias against the flat outer surface of the shaft 1 of the outdoor umbrella.

The adjustable locker 42 has a control portion 421 extended out of the second housing body 12 through a through hole 420 and a gear portion 422 which is extended from the control portion 421 and is engaged with the toothed track 4121 of the driving arm 412 such that when the control portion 421 of the adjustable locker 42 is rotated, the driving arm 412 is slidably moved to selectively drive the pusher head 411 towards the mounting slot 101 for selectively adjusting the size of the mounting slot 101 with respect to the shaft 1 of the outdoor umbrella.

As shown in FIG. 5, the adjustable locker 42 has an elongated circular shape defining an upper portion as the control portion 421 and a mid-portion as the gear portion 422 such that when the control portion 421 of the adjustable locker 42 is rotated, the gear portion 422 is driven to rotate so as to drive the driving arm 412 to move. For example, when the control portion 421 of the adjustable locker 42 is rotated at a clockwise direction, the driving arm 412 is driven to move to push the pusher head 411 towards the mounting slot 101 so as to reduce the size thereof. When the control portion 421 of the adjustable locker 42 is rotated at a counter clockwise direction, the driving arm 412 is driven to move to pull the pusher head 411 away from the mounting slot 101 so as to maximize the size thereof. Therefore, the user is able to adjustably control the size of the mounting slot 101 by turning the control portion 421 of the adjustable locker 42 to mount or detach the audio housing 10 at the shaft 1 of the outdoor umbrella.

Figure 6:
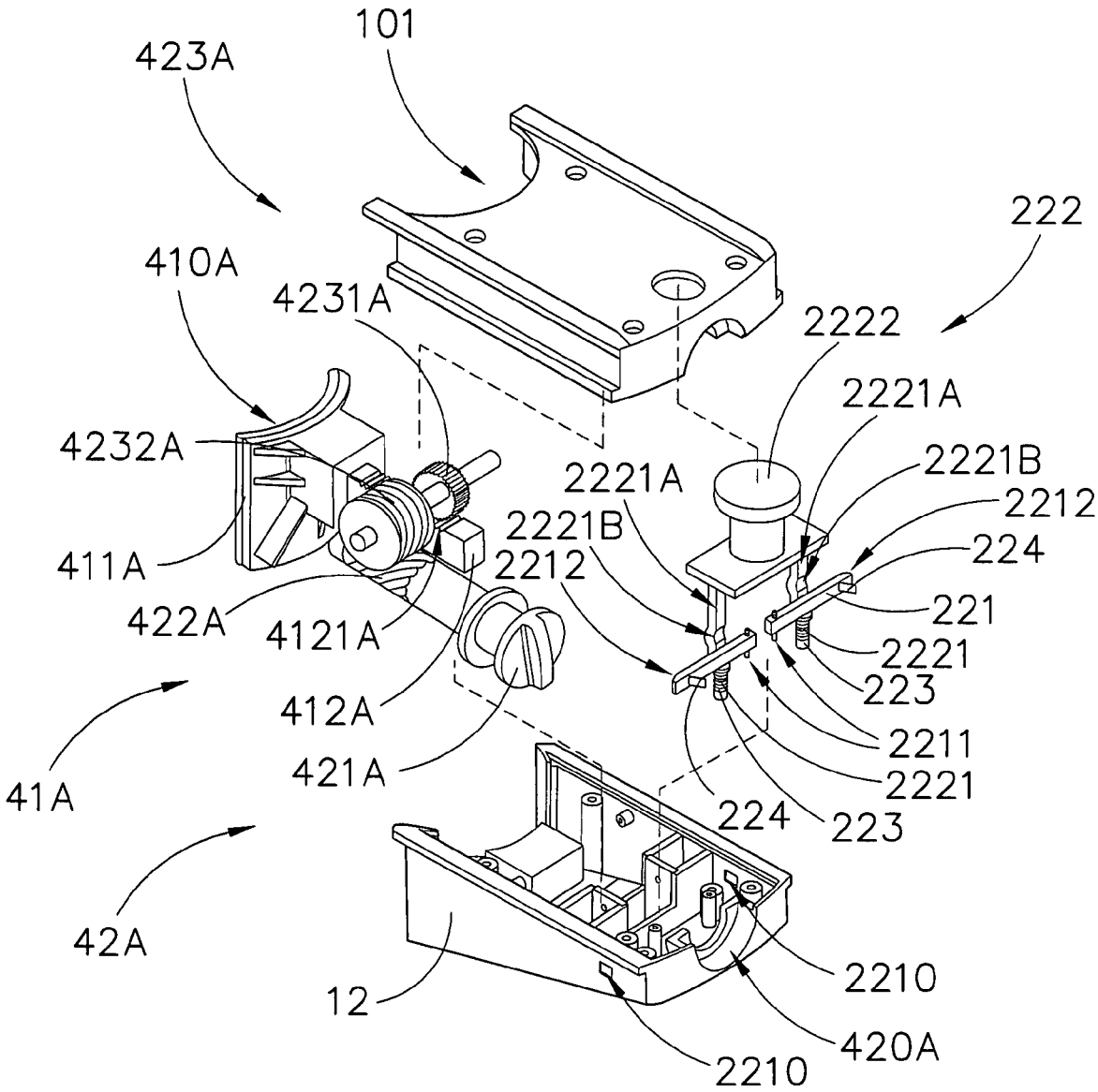
FIG. 6 illustrates an alternative mode of the adjustable retainer according to the above first preferred embodiment of the present invention.

FIG. 6 illustrates an alternative mode of the adjustable retainer 42A according to the above first preferred embodiment of the present invention. As shown in FIG. 5, the adjustable locker 42 is transversely positioned with respect to the retention arm 41, wherein the control portion 421 of the adjustable locker 42 is extended through a top panel of the second housing body 12. The alternative mode of the adjustable retainer 42A has the same structure of the adjustable retainer 42 except a transmission gear 423A. As shown in FIG. 6, the adjustable locker 42A is parallely positioned with respect to the retention arm 41A wherein the control portion 421A of the adjustable locker 42A is extended through a through hole 420A on a side panel of the second housing body 12A. The transmission gear 423A has a first gear portion 4231A engaging with the toothed track 4121A of the retention arm 41A and a second gear portion 4232A engaging with the gear portion 422A of the adjustable locker 42A such that when the control portion 421A of the adjustable locker 42A is rotated, the driving arm 412A is driven to move via the transmission gear 43A to move the position of the pusher surface 410A of the pusher head 411A.

Figure 7:
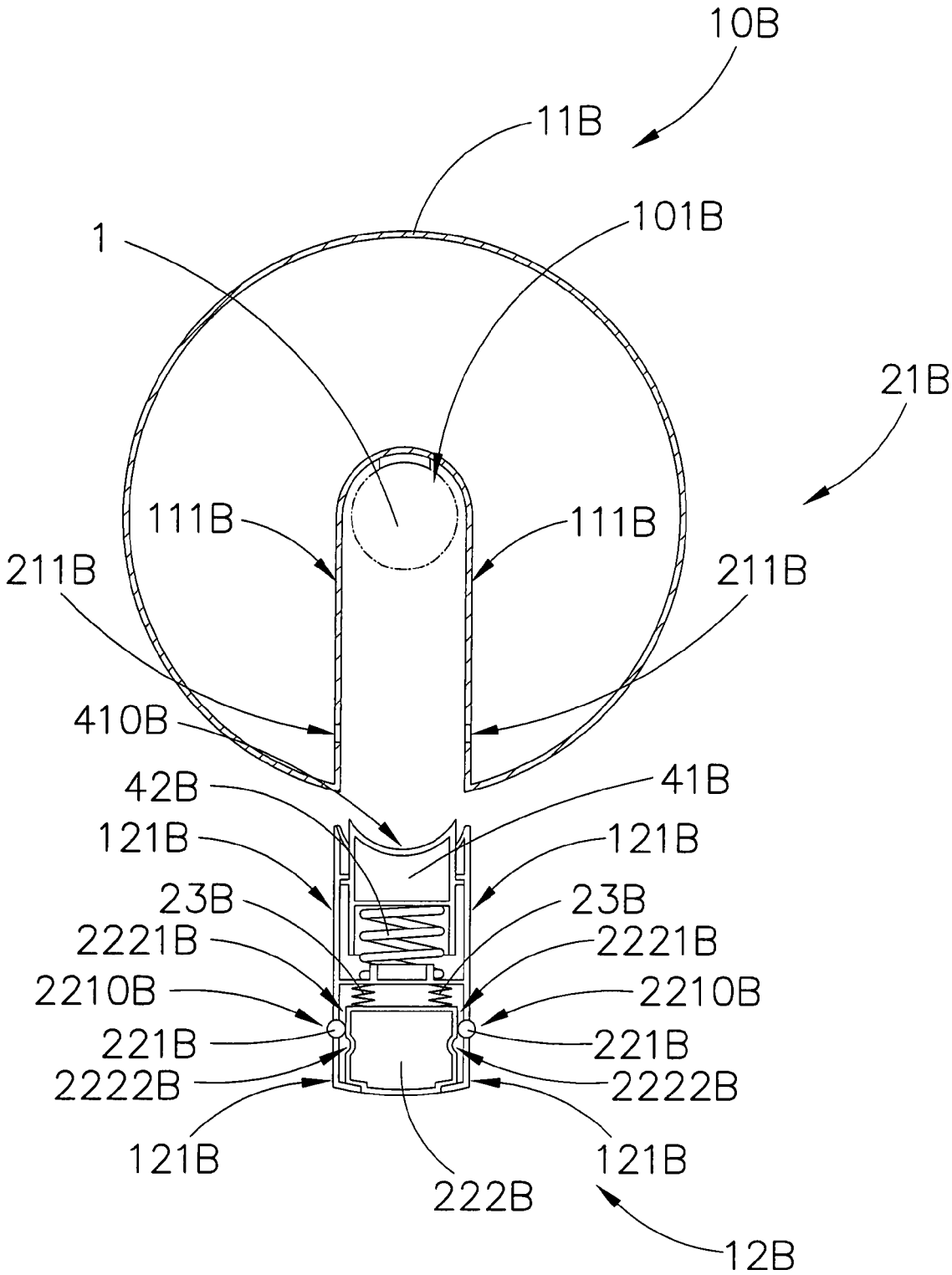
FIG. 7 illustrates another alternative mode of the detachable locker and the adjustable retainer of the audio system according to the above first preferred embodiment of the present invention.

FIG. 7 illustrates another alternative of the detachable locker 20B and the adjustable retainer 40B of the audio system. The detachable locker 20B comprises a first locker 21B provided at the first housing body 11B and a second locker 22B which is provided at the second housing body 12B and is releasably locked with the first locker 21B so as to detachably lock up the second housing body 11B with the first housing body 12B.

The first locker 21B contains two locking slots 211B formed at the inner guiding walls 111B of the first housing body 10B respectively at a position close to the opened end of the guiding channel 112B.

The second locker 22B comprises two ball-shaped locking elements 221B movably provided at the outer guiding walls 121B of the second housing body 12B respectively and a lock actuator 222B actuating the locking elements 221B not only to engage with the locking slots 211B respectively for locking up the second housing body 12B with the first housing body 11B but also to disengage with the locking slots 211B respectively for releasing the second housing body 12B with the first housing body 11B so as to allow the second housing body 12B being detached from the first housing body 11B.

The lock actuator 222B has two sidewalls 2221B and two indentions 2222B formed thereon, wherein when the locking elements 221B are biased against the sidewalls 2221B of the lock actuator 222B, locking portions of the locking elements 221B are protruded from the outer guiding walls 121B of the second housing body 12B through two locking holes 2210B to engage with the locking slots 211B respectively so as to lock up the second housing body 12B with the first housing body 11B.

When the lock actuator 222B is pressed until the locking elements 221B are retained at the indentions 2222B of the locking actuator 222B respectively, the locking portions of the locking elements 221B are moved into an interior of the second housing body 12B through the locking holes 2210B so as to disengage the locking elements 221B with the locking slots 211B respectively. In other words, the two locking elements 221B are normally biased against the two sidewalls 2221B of the lock actuator such that the locking portions of the locking elements 221B are protruded from the outer guiding walls 121B of the second housing body 12B through two locking holes 2210B to engage with the locking slots 211B respectively. When the lock actuator 222B is slid to align the two indentions 2222B with the two locking holes 2210B respectively, the locking elements 221B are disposed at the indentions 2222B respectively. Therefore, the locking portions of the locking elements 221B are moved into an interior of the second housing body 12B to disengage with the locking slots 211B respectively. As shown in FIG. 7, the lock actuator 222B further has a control portion 2223B extended through the second housing body 12B for the user to press on the control portion 2223B to unlock the second housing body 12B from the first housing body 11B.

In order to retain the locking elements 221B at the locking position, the second locker 22B further comprises a first resilient element 23B mounted in the second housing body 12B for applying an urging force against the lock actuator 222B so as to normally retain the locking elements 221B being biased against the sidewalls 2221B of the lock actuator 222B. Accordingly, the first resilient element 23B is a compression spring having two ends biasing against an inner wall of the second housing body 12B and the lock actuator 222B respectively. Therefore, after the control portion 2223B of the lock actuator 222B is pressed to dispose the locking elements 221B at the indentions 2222B respectively, the first resilient element 23B applies the urging force to push the lock actuator 222B back to its original position that the locking elements 221B are biased against the sidewalls 2221B of the lock actuator 222B.

As shown in FIG. 7, the audio system further comprises an adjustable retainer 40B for adjusting the size of the mounting slot 101B for the shaft 1 of the outdoor umbrella, wherein the adjustable retainer comprises a retention arm 41B, having a pusher surface 410B facing towards the mounting slot 101B, slidably mounted the second housing body 10B and an adjustable locker 42B controllably driving the retention arm 41B at a position that when the retention arm 41B is driven towards mounting slot 101B, the pusher surface 410B is arranged for biasing against an outer surface of the shaft 1 of the outdoor umbrella until the shaft 1 thereof being fitted at the mounting slot so as to substantially mount the audio housing 10B at the outdoor umbrella.

Accordingly, the adjustable locker 42B comprises a compression spring supported in the second housing body 10B for applying a pushing force against the retention arm 41B so as to normally push the pusher surface 410B towards the mounting slot 101B. It is worth to mention that the size of the mounting slot 101B is automatically fitted for the size of the shaft 1 of the outdoor umbrella by the self-adjustment of the retention arm 41B via the adjustable locker 42B.

Figure 8:
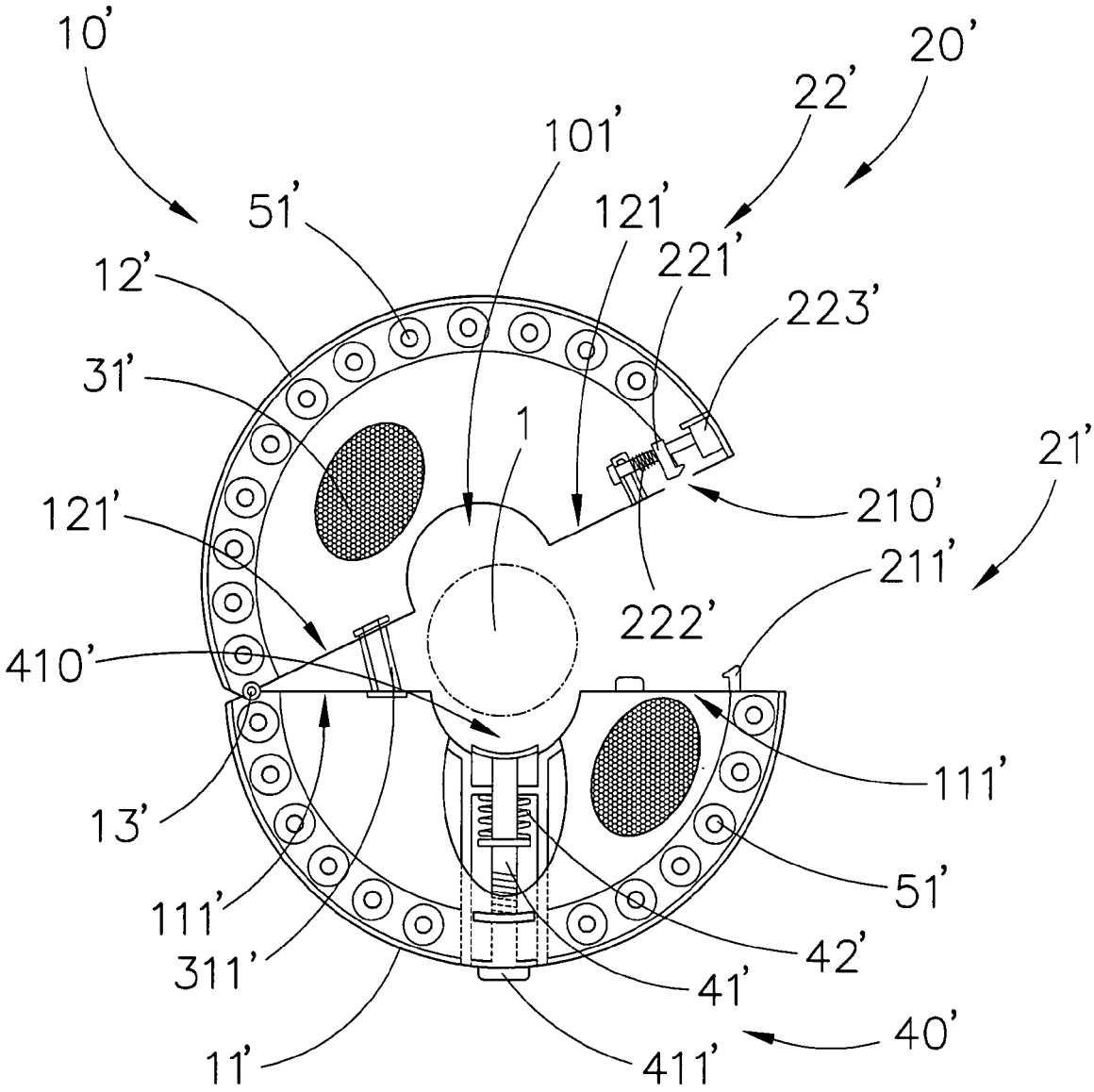
FIG. 8 is a bottom view of an audio system according to a second preferred embodiment of the present invention, illustrating the first and second housing bodies being pivotally coupled with each other via a pivot hinge.

As shown in FIG. 8, an audio system of a second embodiment illustrates an alternative mode of the first embodiment of the present invention, wherein the audio system comprises an audio housing 10', a detachable locker 20' and an audio device 30'. Accordingly, the audio device 30' of the second embodiment has the same configuration of the audio device 30 of the first embodiment.

The audio housing 10' comprises a first housing body 11' and a second housing body 12' defining a mounting slot 101' when the first and second housing bodies 11', 12' are coupled with each other, wherein the mounting slot 101' has a size for the shaft 1 of the outdoor umbrella fitting therewithin.

The detachable locker 20' comprises a first locker 21' provided at the first housing body 11' and a second locker 22' which is provided at the second housing body 12' and is releasably locked with the first locker 21' so as to detachably lock up the second housing body 11' with the first housing body 12'.

As shown in FIG. 8, the first and second housing bodies 11', 12' are two identical half circular bodies pivotally coupling with each other via a pivot hinge 13', wherein each of the first and second housing bodies 11', 12' has two biasing surfaces 111', 121' arranged when the biasing surfaces 111' of the first housing body 11' engage with the biasing surfaces 121' of the second housing body 12' respectively, the audio housing 10' is formed to have a donut shape and to define the mounting slot 101' at a center of the audio housing 10'.

The audio system further comprises a lighting device 50' for providing illumination under the audio housing 10'. The lighting device 50' comprises a plurality of illuminators 51' spacedly supported in the outer circumferential portion of the first and second housing bodies 11', 12' and electrically coupling with the audio device 30'. Accordingly, each of the illuminators 51' is a LED having a head portion protruded from the bottom sides of the first and second housing bodies 11', 12' and a tail portion electrically connecting to the audio device 30'.

The first locker 21' comprises a first locking latch 211' outwardly protruded from one of the biasing surfaces 111' of the first housing body 11'. The second locker 22' comprises a second locking latch 221' movably supported in the second housing body 12' to align with a locking hole 210' on the respective biasing surface 121' of the second housing body 12', wherein when the first locking latch 211' is engaged with the second locking latch 221' through the locking hole 210', the second housing body 12' is locked up with the first housing body 11'.

Accordingly, the second locker 22' further comprises a resilient element 222' supported in the second housing body 12' for applying an urging force against the second locking latch 221' so as to normally retain the second locking latch 221' being locked up with the first locking latch 211', and a lock actuator 223' coupling with the second locking latch 221' and actuating the second locking latch 221' to disengage with the first locking latch 211'. The resilient element 222' is a compression spring having two ends coupling with an inner wall of the second housing body 12' and the second locking latch 221' to apply the urging force against the second locking latch 221'. The lock actuator 223' is coupled with the second locking latch 221' such that when the lock actuator 223' is actuated, the second locking latch 221' is driven to move to disengage with the first locking latch 221' so as to unlock the second housing body 12' from the first housing body 11'. Once the lock actuator 223' is released from its actuated position, the resilient element 222' drives the second locking latch 221' backs to its original position.

Figure 9:
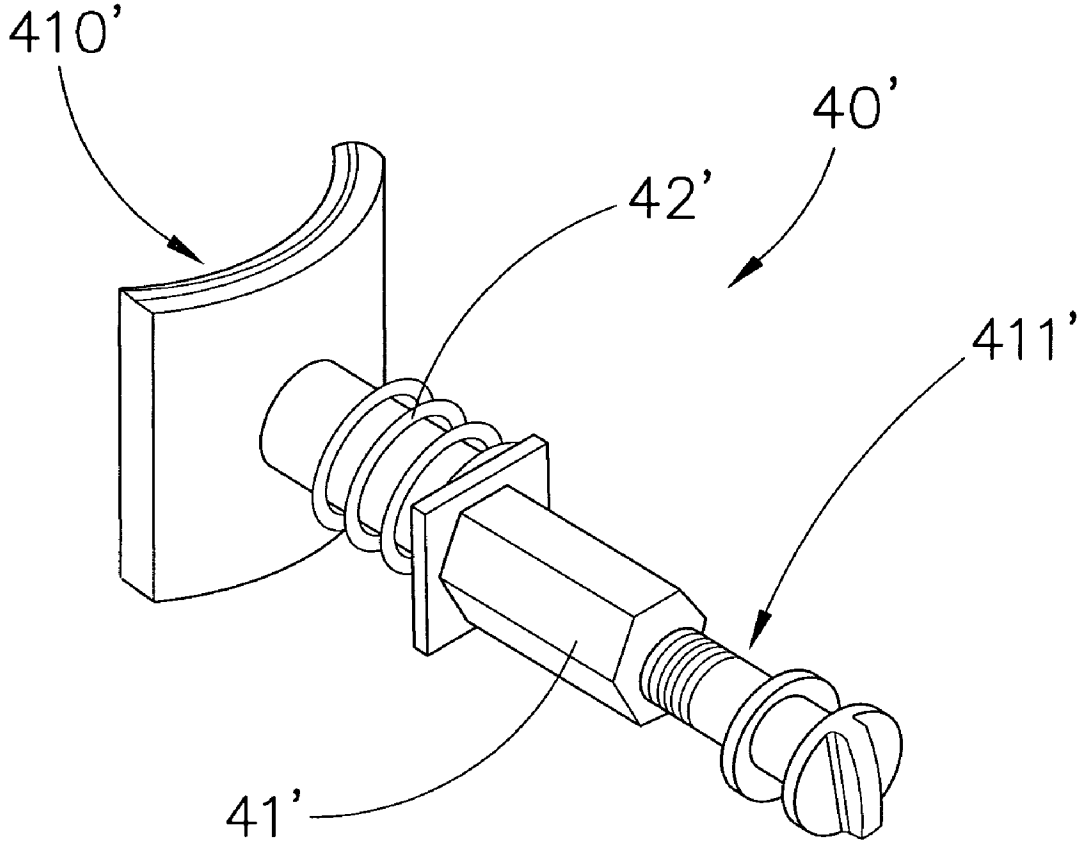
FIG. 9 is a sectional view of the adjustable retainer according to the above second preferred embodiment of the present invention.

The audio system, according to the second embodiment, further comprises an adjustable retainer 40' for adjusting the size of the mounting slot 101' for the shaft 1 of the outdoor umbrella. The adjustable retainer 40' comprises a retention arm 41' having a pusher surface 410' facing towards the mounting slot 101' and a control portion 411' rotatably coupling with the second housing body 12' such that when the control portion 411' is driven to rotate, the pusher surface 410' is adjustably move to adjust the size of the mounting slot 101'. As shown in FIG. 9, the control portion 411' of the retention arm 41' has an outer threaded portion engaging with an inner threaded portion of a sidewall of the second housing body 12'. The adjustable retainer 40' further comprises a compression spring 42' coaxially mounted at the retention arm 41' for applying an urging force against the retention arm 41' to push the pusher surface 410' away from the mounting slot 101'. In other words, when the control portion 411' of the retention arm 41' is rotated to move the pusher surface 410' towards the mounting slot 101', the compression spring 42' is being compressed.

As shown in FIG. 8, the speakers 31' are supported in the first and second housing bodies 11', 12' respectively, wherein an electric cable 311' are extended between the two corresponding biasing surfaces 111', 121' of the first and second housing bodies 11', 12' to electrically connect the speaker 31' with each other. Accordingly, the electric cable 311' not only electrically connects the speakers 31' with each other but also limits a pivot angle between the first and second housing bodies 11', 12'.

Figure 10:
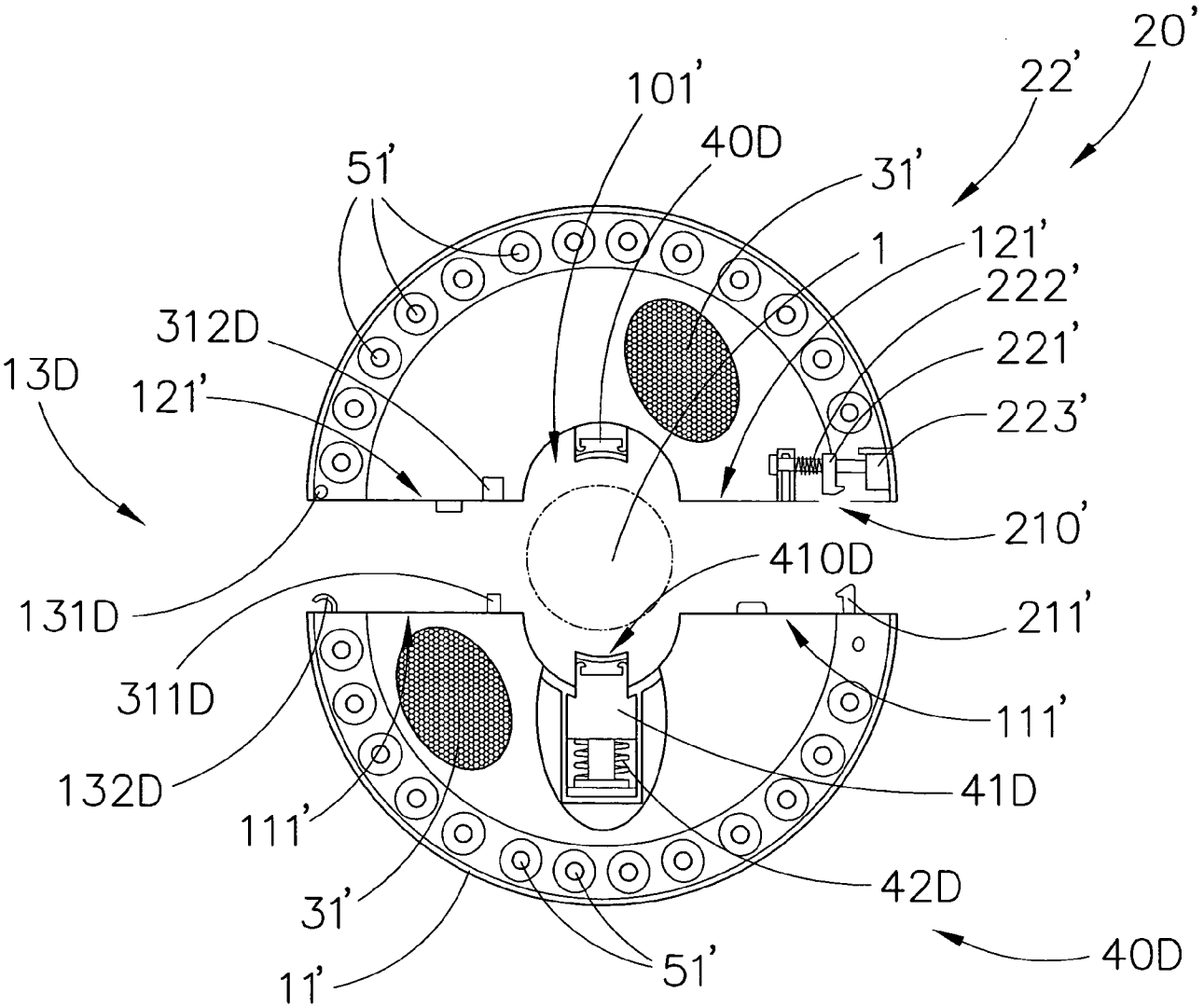
FIG. 10 illustrates an alternative mode of the pivot hinge according to the above second preferred embodiment of the present invention, illustrating the first and second housing bodies being detached with each other via a pivot hinge.

FIG. 10 illustrates an alternative mode of the pivot hinge 13D. As shown in FIG. 10, the first housing body 11' is pivotally coupled with the second housing body 12' via a pivot hinge 13D. The pivot hinge 13D comprises a pivot shaft 131D provided at the first housing body 11' and a detachable coupler 132D which is extended from the second housing body 11' and is detachably coupled with the pivot shaft 131D to pivotally connect the second housing body 12' with the first housing body 11'. Therefore, once the detachable coupler 132D couples with the pivot shaft 131D, the first and second housing bodies 11', 12 are pivotally moved with respect to the pivot shaft 131D. In other words, the pivot hinge 13D not only pivotally connects the first and second housing bodies 11', 12 with each other but also detachably mounts the first and second housing bodies 11', 12 with each other.

The adjustable retainer 40D comprises a retention arm 41D, having a pusher surface 410D facing towards the mounting slot 101', slidably mounted the first housing body 11' and an adjustable locker 42D controllably driving the retention arm 41D at a position that when the retention arm 41D is driven towards mounting slot 101', the pusher surface 410D is arranged for biasing against an outer surface of the shaft 1 of the outdoor umbrella until the shaft 1 thereof being fitted at the mounting slot 101' so as to substantially mount the audio housing 10' at the outdoor umbrella.

Figure 11:
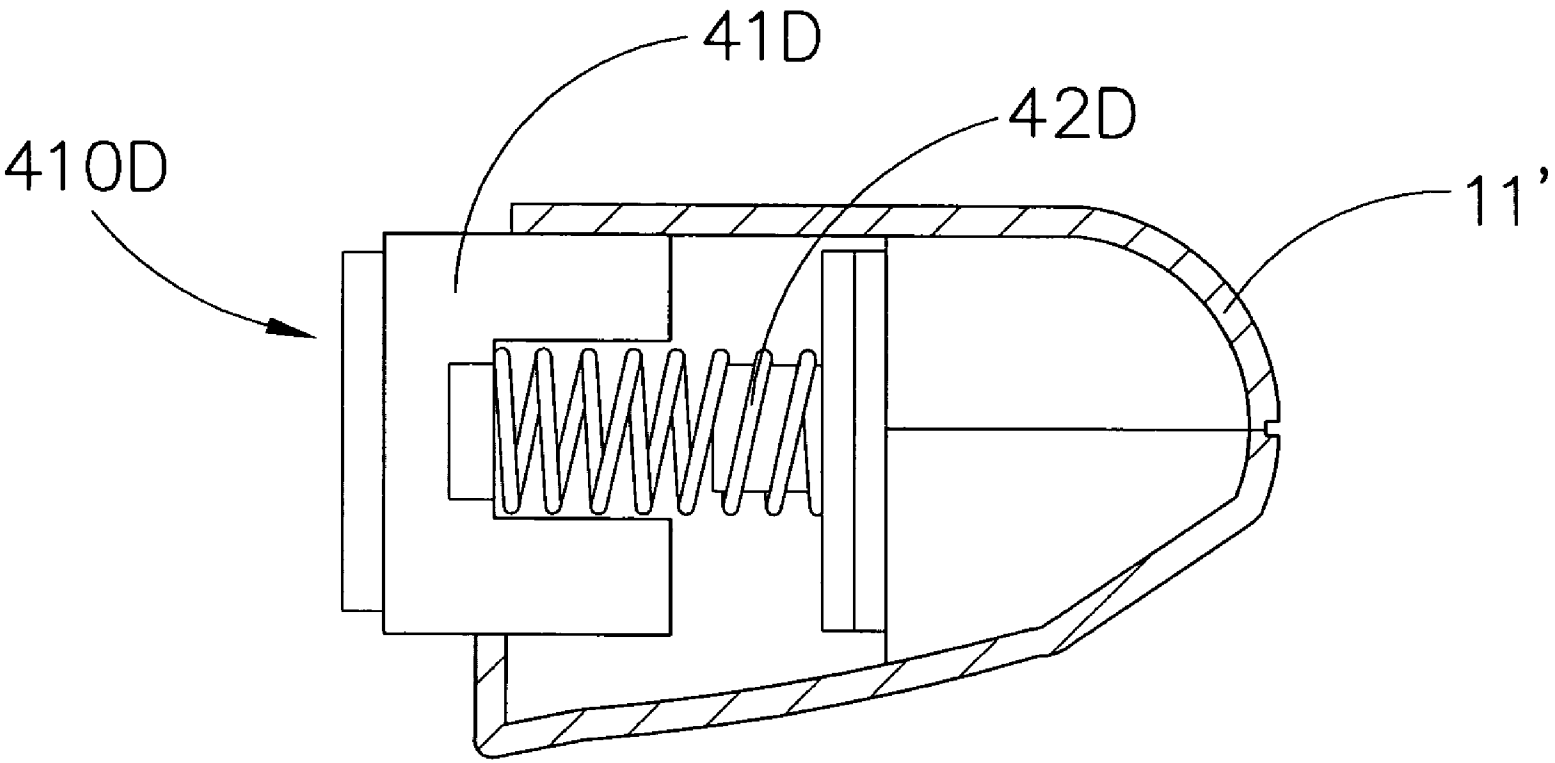
FIG. 11 illustrates an alternative mode of the adjustable retainer according to the above second preferred embodiment of the present invention.

As shown in FIG. 11, The adjustable locker 42D comprises a compression spring supported in the first housing body 11' for applying a pushing force against the retention arm 41D so as to normally push the pusher surface 410D towards the mounting slot 101'.

In addition, since the first housing body 11' can be detached from the second housing body 12' via the pivot hinge 13D, the electric cable 311' should be omitted. In order to electrically connect the speakers 31' at the first and second housing bodies 11', 12', an electric plug 311D is extended from the corresponding biasing surface 111' of the first housing body 11' and is electrically coupled with the speaker 31' thereat. An electric socket 312D is extended from the corresponding biasing surface 121' of the second housing body 12' and is electrically coupled with the speaker 31' thereat, wherein the electric plug 311D is electrically coupled to the electric socket 312D when the first and second housing bodies 11', 12' are coupled with each other via the pivot hinge 13D.

Figure 12:
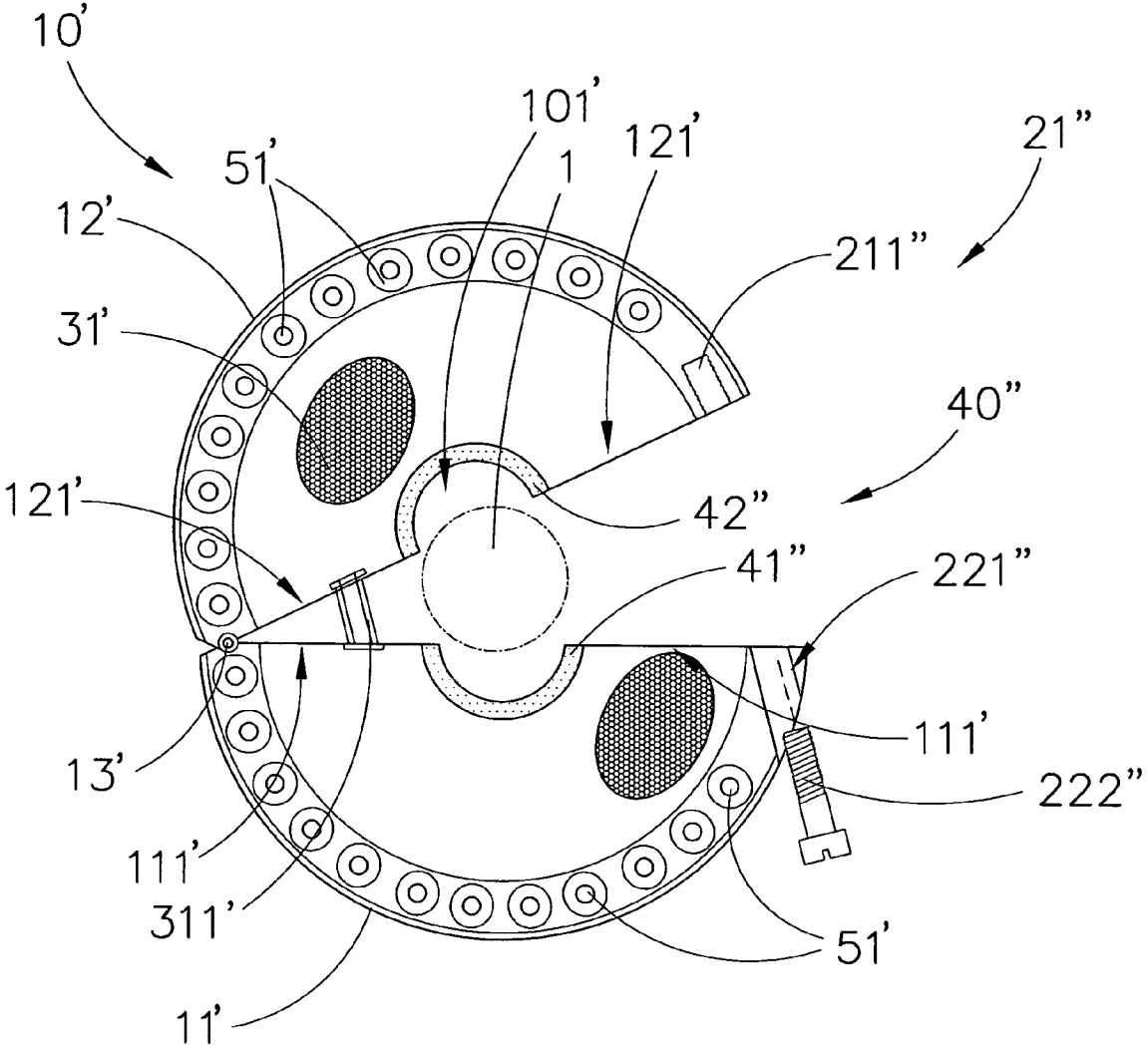
FIG. 12 is a bottom view of an audio system according to a third preferred embodiment of the present invention.

As shown in FIG. 12, an audio system of a third embodiment illustrates an alternative mode of the second embodiment of the present invention, wherein the audio system comprises an audio housing 10", a detachable locker 20" and an audio device 30". Accordingly, the audio device 30" of the third embodiment has the same configuration of the audio devices 30, 30' of the first and second embodiments and the alternatives thereof.

The audio housing 10" comprises a first housing body 11" and a second housing body 12" defining a mounting slot 101" when the first and second housing bodies 11", 12" are coupled with each other, wherein the mounting slot 101" has a size for the shaft 1 of the outdoor umbrella fitting therewithin.

The detachable locker 20" comprises a first locker 21" provided at the first housing body 11" and a second locker 22" which is provided at the second housing body 12" and is releasably locked with the first locker 21" so as to detachably lock up the second housing body 11" with the first housing body 12".

As shown in FIG. 12, the first and second housing bodies 11", 12" are two identical half circular bodies pivotally coupling with each other via a pivot hinge 13", wherein each of the first and second housing bodies 11", 12" has two biasing surfaces 111", 121" arranged when the biasing surfaces 111" of the first housing body 11" engage with the biasing surfaces 121" of the second housing body 12" respectively, the audio housing 10" is formed to have a donut shape and to define the mounting slot 101" at a center of the audio housing 10".

The audio system further comprises a lighting device 50" for providing illumination under the audio housing 10". The lighting device 50" comprises a plurality of illuminators 51" spacedly supported in the outer circumferential portion of the first and second housing bodies 11", 12" and electrically coupling with the audio device 30". Accordingly, each of the illuminators 51" is a LED having a head portion protruded from the bottom sides of the first and second housing bodies 11", 12" and a tail portion electrically connecting to the audio device 30".

The first locker 21" contains a first locking channel 211" formed at the first housing body 11", wherein the first locking channel 211" has an opening formed at one of the biasing surfaces 111' of the first housing body 11".

The second locker 22" contains a second locking channel 221" formed at the second housing body 12", wherein the second locking channel 221" has an opening formed at the corresponding biasing surface 121' of the second housing body 12" to align with the opening of the first locking channel 211" when the biasing surfaces 111", 121" of the first and second housing bodies 11", 12" are engaged with each other. In other words, when the first and second housing bodies 11", 12" are coupled with each other, the first locking channel 211" is coaxially aligned with the second locking channel 212". The second locker 22" further comprises an elongated locking shaft 222" rotatably extended from the second locking channel 212" to the first locking channel 211" to lock up the second housing body 12" with the first hosing body 11". Accordingly, each of the first and second locking channels 211", 221" has an inner threaded portion wherein the locking shaft 222" has a corresponding outer threaded portion arranged in such a manner that when the locking shaft 222" is rotatably extended from the second locking channel 212" to the first locking channel 211", the second housing body 12" is locked up with the first hosing body 11".

It is worth to mention that the detachable locker 20" of the third embodiment can be incorporated with the audio housing 10 of the first embodiment that the first locking channel 211" of the first locker 21" contains two portions formed at the first housing body 11 while the second locking channel 212" of the second locker 22" can be formed at the second housing body 12 to coaxially align between the two portions of the first locking channel 211" such that the locking shaft 222" is rotatably extended to portions of the first locking channel 211" through the second locking channel 221" to lock the second housing body 12 to the first housing body 11.

The audio system further comprises an adjustable retainer 40" for adjusting the size of the mounting slot 101" for the shaft 1 of the outdoor umbrella, wherein the adjustable retainer 40" comprises a first foaming element 41" provided at the first housing body 11" at the mounting slot 101" and a second foaming element 42" provided at the second housing body 12" at the mounting slot 101" and arranged when the first and second housing bodies 11", 12" are engaged with each other, the first and second foaming elements 41", 42" are adapted for biasing against the outer side of the shaft 1 of the outdoor umbrella to securely retain the audio housing 10" around the shaft 1 of the outdoor umbrella. It is worth to mention that when the shaft 1 of the outdoor umbrella is sandwiched between the first and second foaming elements 41", 42", the first and second foaming elements 41", 42" are self-deformed to fit the size of the shaft 1 of the outdoor umbrella, so as to hold the audio housing 10" at the shaft 1 of the outdoor umbrella by means of frictional force. Preferably, the first and second foaming elements 41", 42" are two arc shaped elements to encircle with the shaft 1 of the outdoor umbrella.

It is worth to mention that the audio housing 10, 10', 10", the detachable locker 20, 20', 20", the audio device 30", and the adjustable retainer 40, 40', 40" of the first to third embodiments and their alternatives are interchangeable that the first and second foaming elements 41", 42" of the adjustable retainer 40" can be used in the first embodiment of the present invention while the detachable locker 20' can be used in the third embodiment of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments and their alternatives have been shown and described for the purposes of illustrating the functional and structural principles of the present invention and is subject to change without departure from such principles. Therefore, this invention includes all modifications encompassed within the spirit and scope of the following claims.

What is claimed is:

1. An audio system for an outdoor umbrella having a shaft, comprising:

an audio housing which comprises a first housing body and a second housing body defining a mounting slot when said first and second housing bodies are coupled with each other, wherein said mounting slot has a size for said shaft of said outdoor umbrella fitting therewithin;

a detachable locker comprising a first locker provided at said first housing body and a second locker which is provided at said second housing body and is releasably locked with said first locker to detachably lock up said second housing body with said first housing body for securely mounting said audio housing around said shaft of said outdoor umbrella; and an audio device which comprises one or more speakers supported in said audio housing and an audio input operatively coupling with said speaker such that when said audio input sends an audio signal to said speaker, said speaker is adapted for producing audio sound as an additional function for said outdoor umbrella, wherein said first housing body, having a U-shaped structure, has two inner guiding walls defining a guiding channel therebetween, wherein said second housing body, having a corresponding shape, has two outer guiding walls engaging with said inner guiding walls of said first housing body, wherein said guiding channel has a closed end defining said mounting slot thereat and an opened end arranged when said second housing body is slidably mounted to said first housing body, along said guiding channel through said opened end thereof, said mounting slot is formed at said closed end of said guiding channel.

2. The audio system, as recited in claim 1, wherein said first locker comprises two toothed-locking tracks provided at said inner guiding walls of said first housing body respectively, wherein said second locker comprises two locking arms outwardly extended from said outer guiding walls of said second housing and a lock actuator actuating said locking arms to engage with said toothed-locking tracks respectively for locking up said second housing body with said first housing body and to disengage with said toothed-locking tracks respectively for releasing said second housing body with said first housing body so as to allow said second housing body being detached from said first housing body.

3. The audio system, as recited in claim 2, wherein each of said locking arms has an inner pivot end pivotally mounted in said second housing body and an outer locking end outwardly protruded from said respective outer guiding wall of said second housing body through a locking hole to selectively engage with said respective toothed-locking track, wherein said lock actuator comprises two actuating legs movably mounted in said second housing body to engage with said locking arms respectively and a control pusher which is extended from said actuating legs to an exterior of said second housing body and is arranged in such a manner that when said control pusher is depressed, said actuating legs are pushed to pivotally move said locking arms at a position that said locking ends of said locking arms are moved into an interior of said second housing body through said locking holes so as to disengage said locking ends of said locking arms with said toothed-locking tracks respectively.

4. The audio system, as recited in claim 3, wherein each of said actuating legs has a straight biasing portion and a curved releasing portion that said locking arms are normally engaged with said curved releasing portions of said actuating legs to retain said locking ends of said locking arms engaging with said toothed-locking tracks respectively, wherein when said control pusher is depressed to move said actuating legs, said locking arms are engaged with said straight biasing portions of said actuating legs to pivotally move said locking ends of said locking arms into said interior of said second housing body through said locking holes so as to disengage said locking ends of said locking arms with said toothed-locking tracks respectively.

5. The audio system, as recited in claim 4, wherein said second locker further comprises two first resilient elements mounted at two free ends of said actuating legs for applying an urging force against said control pusher to retain said control pusher in a normal position and two second resilient elements provided at said two locking arms for applying a pushing force against said locking arms with respect to sidewalls of said locking holes so as to retain said locking ends of said locking arms to engage with said toothed-locking tracks respectively.

6. The audio system, as recited in claim 5, further comprising an adjustable retainer for adjusting the size of said mounting slot for said shaft of said outdoor umbrella, wherein said adjustable retainer comprises a retention arm, having a pusher surface facing towards said mounting slot, slidably mounted said second housing body and an adjustable locker controllably driving said retention arm at a position that when said retention arm is driven towards mounting slot, said pusher surface is arranged for biasing against an outer surface of said shaft of said outdoor umbrella until said shaft thereof being fitted at said mounting slot so as to substantially mount said audio housing at said outdoor umbrella.

7. The audio system, as recited in claim 6, wherein said retention arm comprises a pusher head defining said pusher surface thereat and a driving arm, having a toothed track, extended from said pusher head, wherein said adjustable locker has a control portion extended out of said second housing body and a gear portion which is extended from said control portion and is engaged with said toothed track of said driving arm such that when said control portion of said adjustable locker is rotated, said driving arm is slidably moved to selectively drive said pusher head towards said mounting slot for selectively adjusting the size of said mounting slot with respect to said shaft of said outdoor umbrella.

8. The audio system, as recited in claim 1, wherein said first locker contains two locking slots formed at said inner guiding walls of said first housing body respectively, wherein said second locker comprises two ball-shaped locking elements movably provided at said outer guiding walls of said second housing body respectively and a lock actuator actuating said locking elements to engage with said locking slots respectively for locking up said second housing body with said first housing body and to disengage with said locking slots respectively for releasing said second housing body with said first housing body so as to allow said second housing body being detached from said first housing body.

9. The audio system, as recited in claim 8, wherein said lock actuator has two sidewalls and two indentions formed thereon, wherein when said locking elements are biased against said sidewalls of said lock actuator, locking portions of said locking elements are protruded from said outer guiding walls of said second housing body through two locking holes to engage with said locking slots respectively so as to lock up said second housing body with said first housing body, wherein when said lock actuator is pressed until said locking elements are retained at said indentions of said locking actuator respectively, said locking portions of said locking elements are moved into an interior of said second housing body through said locking holes so as to disengage said locking elements with said locking slots respectively.

10. The audio system, as recited in claim 9, wherein said second locker further comprises a first resilient element mounted in said second housing body for applying an urging force against said lock actuator so as to normally retain said locking elements being biased against said sidewalls of said lock actuator.

11. The audio system, as recited in claim 10, further comprising an adjustable retainer for adjusting the size of said mounting slot for said shaft of said outdoor umbrella, wherein said adjustable retainer comprises a retention arm, having a pusher surface facing towards said mounting slot, slidably mounted said second housing body and an adjustable locker controllably driving said retention arm at a position that when said retention arm is driven towards mounting slot, said pusher surface is arranged for biasing against an outer surface of said shaft of said outdoor umbrella until said shaft thereof being fitted at said mounting slot so as to substantially mount said audio housing at said outdoor umbrella.

12. The audio system, as recited in claim 11, wherein said adjustable locker comprises a compression spring supported in said second housing body for applying a pushing force against said retention arm so as to normally push said pusher surface towards said mounting slot.

13. An audio system for an outdoor umbrella having a shaft, comprising:

an audio housing which comprises a first housing body and a second housing body defining a mounting slot when said first and second housing bodies are coupled with each other, wherein said mounting slot has a size for said shaft of said outdoor umbrella fitting therewithin;

a detachable locker comprising a first locker provided at said first housing body and a second locker which is provided at said second housing body and is releasably locked with said first locker to detachably lock up said second housing body with said first housing body for securely mounting said audio housing around said shaft of said outdoor umbrella;

an audio device which comprises one or more speakers supported in said audio housing and an audio input operatively coupling with said speaker such that when said audio input sends an audio signal to said speaker, said speaker is adapted for producing audio sound as an additional function for said outdoor umbrella; and an adjustable retainer for adjusting the size of said mounting slot for said shaft of said outdoor umbrella, wherein said adjustable retainer comprises a retention arm, having a pusher surface facing towards said mounting slot, slidably mounted said second housing body and an adjustable locker controllably driving said retention arm at a position that when said retention arm is driven towards mounting slot, said pusher surface is arranged for biasing against an outer surface of said shaft of said outdoor umbrella until said shaft thereof being fitted at said mounting slot so as to substantially mount said audio housing at said outdoor umbrella.

14. The audio system, as recited in claim 13, wherein said retention arm comprises a pusher head defining said pusher surface thereat and a driving arm, having a toothed track, extended from said pusher head, wherein said adjustable locker has a control portion extended out of said second housing body and a gear portion which is extended from said control portion and is engaged with said toothed track of said driving arm such that when said control portion of said adjustable locker is rotated, said driving arm is slidably moved to selectively drive said pusher head towards said mounting slot for selectively adjusting the size of said mounting slot with respect to said shaft of said outdoor umbrella.

15. An audio system for an outdoor umbrella having a shaft, comprising:

an audio housing which comprises a first housing body and a second housing body defining a mounting slot when said first and second housing bodies are coupled with each other, wherein said mounting slot has a size for said shaft of said outdoor umbrella fitting therewithin;

a detachable locker comprising a first locker provided at said first housing body and a second locker which is provided at said second housing body and is releasably locked with said first locker to detachably lock up said second housing body with said first housing body for securely mounting said audio housing around said shaft of said outdoor umbrella;

an audio device which comprises one or more speakers supported in said audio housing and an audio input operatively coupling with said speaker such that when said audio input sends an audio signal to said speaker, said speaker is adapted for producing audio sound as an additional function for said outdoor umbrella, wherein said first and second housing bodies are two identical half circular bodies pivotally coupling with each other, wherein each of said first and second housing bodies has two biasing surfaces arranged when said biasing surfaces of said first housing body engage with said biasing surfaces of said second housing body respectively, said audio housing is formed to have a donut shape and to define said mounting slot at a center of said audio housing; and an adjustable retainer for adjusting the size of said mounting slot for said shaft of said outdoor umbrella, wherein said adjustable retainer comprises a first foaming element provided at said first housing body and a second foaming element which is provided at said second housing body and is arranged when said first and second housing bodies are engaged with each other, said first and second foaming elements are adapted for biasing against the outer side of the shaft of the outdoor umbrella to securely retain said audio housing around the shaft of the outdoor umbrella.

16. The audio system, as recited in claim 15, wherein said first locker contains a first locking channel formed at said first housing body, wherein said second locker which contains a second locking channel formed at said second housing body and comprises an elongated locking shaft rotatably extended from said second locking channel to said first locking channel to lock up said second housing body with said first hosing body.

* * * * *